United States Patent [19]

Ishizuka

[11] Patent Number: 4,976,999

[45] Date of Patent: Dec. 11, 1990

[54] METHOD OF SIMULTANEOUS MULTILAYER APPLICATION

[75] Inventor: Seiji Ishizuka, Kanagawa, Japan

[73] Assignee: Fuji Photo Film Co., Ltd., Kanagawa, Japan

[21] Appl. No.: 397,813

[22] Filed: Aug. 24, 1989

Related U.S. Application Data

[62] Division of Ser. No. 260,226, Oct. 20, 1988.

[30] Foreign Application Priority Data

Oct. 20, 1987 [JP] Japan ..... 62-262865
Oct. 20, 1987 [JP] Japan ..... 62-262866
Nov. 25, 1987 [JP] Japan ..... 62-295134

[51] Int. Cl.[5] ..... B05D 1/30

[52] U.S. Cl. ..... 427/420; 427/402; 118/410; 118/411

[58] Field of Search ..... 427/420; 118/410, 411

[56] References Cited

U.S. PATENT DOCUMENTS 4,113,903 9/1978 Choinski ..... 427/420
4,154,879 5/1979 Choinski ..... 427/402

FOREIGN PATENT DOCUMENTS 0003860 2/1979 European Pat. Off. .
0018029 3/1980 European Pat. Off. .
3238904 10/1982 Fed. Rep. of Germany .
2310809 5/1976 France .

OTHER PUBLICATIONS

English Abstract of Japan 61-197418, 8/25/86.
English Abstract of Japan 59-98491, 5/18/84.

*Primary Examiner*—Shrive Beck
*Attorney, Agent, or Firm*—Sughrue, Mion, Zinn, Macpeak & Seas

[57] ABSTRACT

A device for simultaneous multilayer application in which discrete liquid substances are applied as at least two mutually-overlaid layers to a continuously moving web comprises a web, a backup roller around which the web moves and a hopper for simultaneously applying upper and lower layers to the web. The hopper includes first and second guide surfaces along which the liquid substances flow onto the web, and first and second slots for individually supplying the liquid substances to each of the guide surfaces. The slots are designed such that the length of the slot for supplying the lower layer is longer than the length of slot for supplying the upper layer and the width of the slot for supplying the lower layer is smaller than the width of the slot for supplying the upper layer. In this manner, the edges of the applied liquid substances are continuous along the length of the web and streaks are prevented from forming along the applied surfaces.

1 Claim, 4 Drawing Sheets

METHOD OF SIMULTANEOUS MULTILAYER APPLICATION

This is a divisional of Application No. 07/260,226 filed Oct. 20, 1988.

BACKGROUND OF THE INVENTION

The present invention relates to a method of applying a liquid composite substance to a continuously moving web in manufacturing a photographic photosensitive material such as a photographic film and printing paper, a photoengraving material or a recording material such as pressure-sensitive recording paper and thermosensitive recording paper. More particularly, the invention relates to a method of simultaneously applying liquid substances as two or more mutually-overlaid layers to a continuously moving web.

A method of rapid simultaneous multilayer application in a slide-hopper-type application device or the like was disclosed in the U.S. Pat. No. 4,001,024. In order to increase the application speed in the method, a liquid substance having a viscosity as low as 1 cps to 8 cps is applied as the lowermost layer to a web to set the degree of wet application of the liquid substance at 2 $cm^3$to 12 $cm^3$ per 1 $m^2$ of the surface of the web. A meniscoid vertical movement is allowed only to mix the lowermost layer and the second lowermost layer with each other but not allowed to affect the other layers.

A method of applying to a web a thin carrier layer of a pseudo-plastic liquid substance of 20 cps to 200 cps in viscosity at the shear rate of 100 $sec^{-1}$ and 10 cps or less in viscosity at the shear rate of 100,000 $sec^{-1}$ was disclosed in the U.S. Pat. No. 4,113,903. In the method, the pseudoplastic liquid substance whose viscosity is high at the low shear rate and low at the high shear rate is used as the lowermost layer on the web in order to eliminate the instability of an application bead, as in the method disclosed in the U.S. Pat. No. 4,001,024. The liquid substance is characterized in that it performs non-Newtonian flow. The liquid substance needs to be a selected special composite substance and subjected to careful preparation.

SUMMARY OF THE INVENTION

As shown in The Japanese Patent Application (OPI) No. 54975/1988 (not prior art) the present inventor has developed a method of rapid simultaneous multilayer application in a slide-hopper-type application device. The method is characterized in that a liquid substance for making the lowermost layer on a web is water, the degree of wet application of the liquid substance is 2 $cm^3$ or less per 1 $m^2$ of the surface of the web, and the second lowermost layer on the lowermost layer has a larger thickness then the latter and is made of a water-soluble liquid composite substance of high viscosity.

The present invention is conducted in order to remove deficiencies of the method which will be discussed hereinafter.

FIG. 1 shows a plan view of an example of the application device, in which a slot 5*a* for supplying an applied substance forming the lowermost layer on a web, a slot 8 for supplying an applied substance forming the second lowermost layer and a slot 11 for supplying an applied substance forming the third lowermost layer are equal in length.

When rapid application is to be performed in the above-mentioned method, the side edges of an application bead 3*a* become so unstable that the applied liquid substances are discontinuous at the side edges thereof. For that reason, it is difficult to perform the rapid application properly in the method. As a result of intensive study on the cause of the discontinuity of the side edges of the applied liquid substance, it has been discovered that water, which is the liquid substance for making the lowermost layer, has a large difference in viscosity and surface tension from the other liquid substances for making the second and the third lowermost layers. Therefore, the water does not sufficiently spread to the side edges of the application bead 3*a* and wet them.

The present invention was made in order to solve the above-mentioned problem of the application method.

Accordingly, it is the first object of the present invention to provide a simultaneous multilayer application device capable of properly performing stable rapid application.

In the simultaneous multilayer application device provided in accordance with the present invention, liquid substances are applied as two or more mutually-overlaid layers to a continuously moving web. The device is characterized in that the length of a slot for supplying the liquid substance for making the lowermost layer on the web is made larger than that of a slot for supplying the liquid substance for making the second lowermost layer.

A further detailed study was conducted on the condition of the surface of the liquid substance applied in the method of the publication No. 54975/1988. It was discovered that a transverse non-uniformity takes place in the layer of the applied liquid substances over all or a part of the width of the layer in the range of relatively low application speeds under some application conditions. Further, it has been discovered that the nonuniformity takes place in the range of higher application speed as well if the quantity of water for making the lowermost layer, the back pressure for stabilizing the application bead or the gap between the web on a backup roller and the application device, in which the application bead is formed is, increased. Finally, it has also been discovered that the nonuniformity takes place because the application bead formed in the gap between the web on the back roller and the application device falls to the lip surface of the tip portion of the application device and vibrates.

The present invention was made in order to solve this problem.

Accordingly, it is another object of the present invention to provide a method of rapid stable simultaneous multilayer application without the above problem.

Therefore, in the method provided in accordance with the present invention, liquid substances are applied as two or more mutually-overlaid layers to a continuously moving web, the liquid substance adjoining the surface of the web being water, and the other liquid substance adjoining the water forming the layer of larger thickness than the water and being a water-soluble composite substance of high viscosity. The method is characterized in that the viscosity of the liquid substance adjoining the water-13 is 40 cps or more at the shear rate of 100 $sec^{-1}$.

In the slide-hopper-type application device of the publication No. 54975/198, the width $C_1$ of a slot 5 for supplying a liquid substances for the lowermost layer on a web, the width $C_2$ of a slot 8 for supplying a liquid substance for the second lowermost layer, and the width $C_3$ of a slot 11 for supplying a liquid substance for the third lowermost layer are equal to each other as shown in FIG. 2 (side view).

The present application is to be performed by the application device, very slight streaks take place as defects in the surface of the assembly of the layers in the direction of the application, randomly along the width of the web.

The present invention was made in order to solve the above-mentioned problem.

Accordingly, it is a further object of the present invention to provide a simultaneous multilayer application device capable of performing stable rapid application without causing a very slight streak as a defect in the direction of the application.

As a result of intensive study on the cause of the occurrence of the streak, it has been discovered that the streak occurs because the applied liquid substance 15 for making the second lowermost layer falls at the outlet opening of the slot 5 through which the applied liquid substance 14 for making the lowermost layer is supplied, as shown in FIG. 3.

Therefore, the simultaneous multilayer application device provided in accordance with the present invention applies liquid substances as two or more mutually-overlaid layers to a continuously moving web. The device is characterized in that the width of a slot for supplying the liquid substance for forming the lowermost layer is smaller than that of a slot for supplying the liquid substance for forming the second lowermost layer. The width of the slot for supplying the liquid substance for forming the lowermost layer is set at 0.05 mm to 0.07 mm, preferably 0.1 mm to 0.5 mm. The width of the slot for supplying the liquid substance for forming the second lowermost layer is set at 0.1 mm to 115 mm, preferably 0.2 mm to 1.0 mm.

Furthermore, the bead back pressure may be applied to the simultaneous multilayer application method or device of the present invention, in order to make the bead stable. The application of the back pressure for the bead is described in detail in the U.S. Pat. No. 3,220,988.

DETAILED DESCRIPTION OF THE PREFERRED EMBODIMENTS

Figure 1:
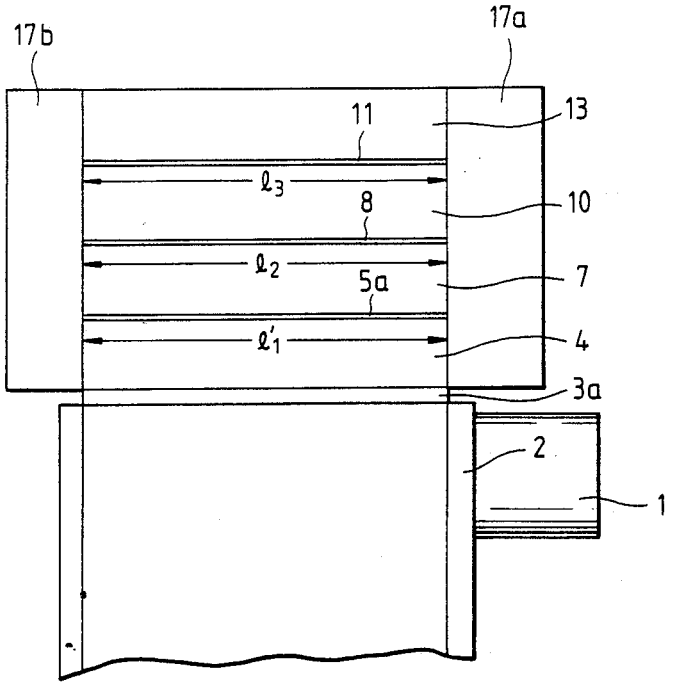
FIG. 1 shows a plan view of the present inventor's already developed slide-hopper-type application device for simultaneously applying three layers.
Figure 2:
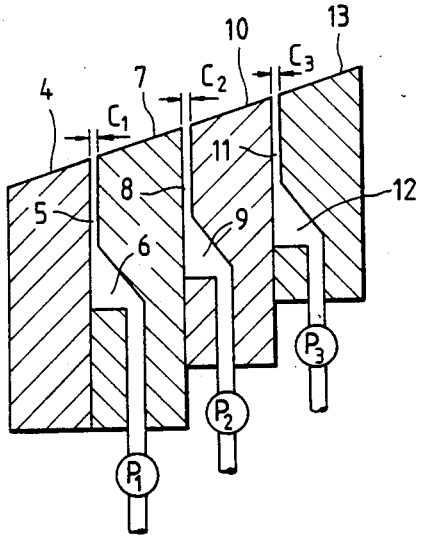
FIG. 2 shows a sectional view of the application device of FIG. 1
Figure 3:
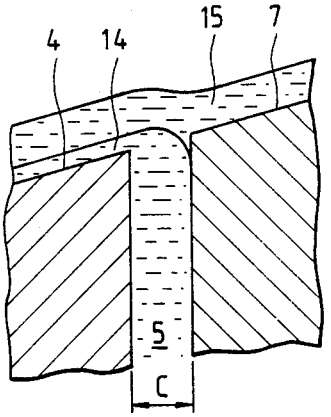
FIG. 3 shows an enlarged sectional partial view for describing the occurrence of a streak.
Figure 4:
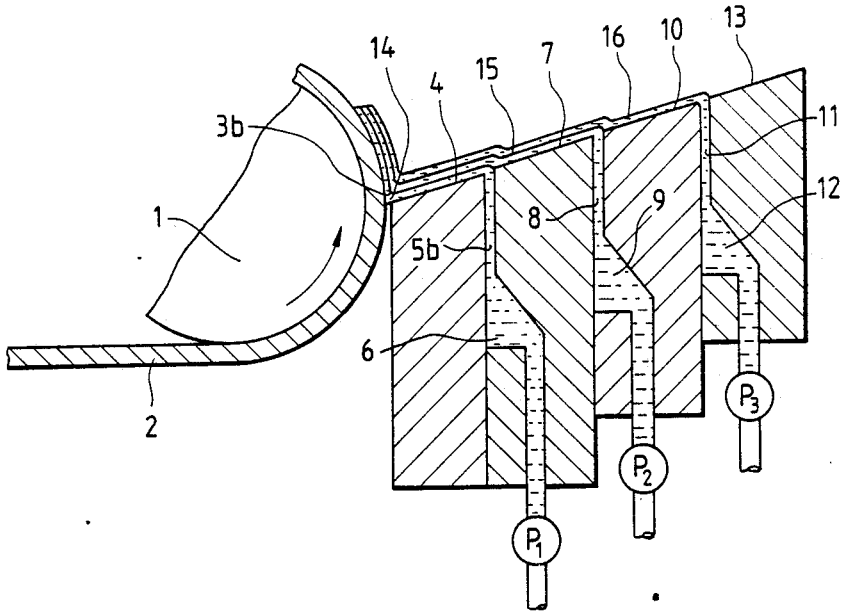
FIG. 4 shows a sectional view of a slide-hopper-type application device for simultaneously applying three layers in a stable rapid simultaneous multilayer application method to which the present invention is to be applied.

Embodiments of the present invention , which are methods and apparatuses for rapid stable simultaneous multilayer application, are hereafter described with reference to the drawings attached hereto. FIG. 4 shows a sectional view of a slide-hopper-type application device to which the present invention is to be applied. Shown in FIG. 4 are a backup roller 1, a web 2, a bead 3(*b*), slide surfaces 4, 7, 10 and 13, slots 5(*b*), 8 and 11, manifold spaces 6, 9 and 12, a water film 14 constituting the lowermost layer on the web, a liquid substance film 15 constituting the second lowermost layer, and a liquid substance film 16 constituting the third lowermost layer. The web 2 is continuously moved in a direction shown by an arrow in FIG. 1, on the peripheral surface of the backup roller 1 by a conveyance means not shown in the drawing. The water 14 for making the lowermost layer is supplied by a pump $P_1$ so that the water is spread to the entire width of the slot 5(*b*) by the manifold space 6. The water then flows from the slot 5(*b*) to the slide surface 4, gravitates thereon and forms the bead 3(*b*) so that the water is applied to the web 2. The other liquid substances 15 and 16 for making the second and the third lowermost layers, which become the first and second layers of a final product, respectively, are similarly applied to the web 2 through the manifold spaces 9 and 12 and the slots 8 and 11 along the slide surfaces 7 and 10 while being overlaid on the water film 14 and forming the bead 3(*b*) together therewith.

Figure 5:
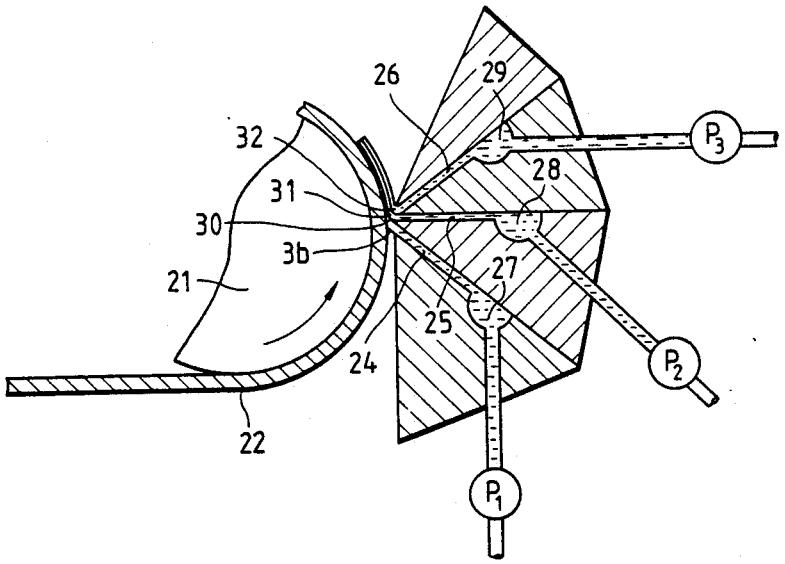
FIG. 5 shows a sectional view of an extrusion-type application device for simultaneously extrusion-type application device for simultaneously applying three layers in a stable rapid simultaneous multilayer application method to which the present invention is to be applied.

FIG. 5 shows a sectional view of an extrusion-type application device for simultaneously applying three layers in a rapid stable simultaneous multilayer application method to which the present invention is to be applied. Shown in FIG. 5 are a backup roller 21, a web 22, slots 24, 25 and 26, manifold spaces 27, 28 and 29, a water film 30 constituting the lowermost layer on the web, a liquid substance film 31 constituting the second lowermost layer, which becomes the first layer of a final product, and a liquid substance film 32 constituting the third lowermost layer, which becomes the second layer of the final product. The web 22 is continuously moved in a direction shown by an arrow in FIG. 5, on the peripheral surface of the backup roller 21 by a conveyance means, not shown in the drawing. The water 30 for making the lowermost layer si supplied by a pump $P_1$ so that the water is spread to the entire width of the slot 24 by the manifold space 27. The water is the pumped through the slot 24 and applied to the web 22. The other liquid substances 31 and 32 for making the second and the third lowermost layers are similarly pumped through the manifold spaces 28 and 29 and the slots 25 and 26, respectively, and applied to the web 22 together with the water 30.

[FIRST EMBODIMENT]

The simultaneous multilayer application device of the first embodiment of the invention will be described hereinafter. The device is the simultaneous multilayer application device, wherein liquid substances are applied as two or more mutually-overlaid layers to a continuously moving web. The device is characterized in that the length of a slot for supplying the liquid substance for making the lowermost layer on the web is made larger than that of a slot for supplying the liquid substance for making the second lowermost layer.

Figure 6:
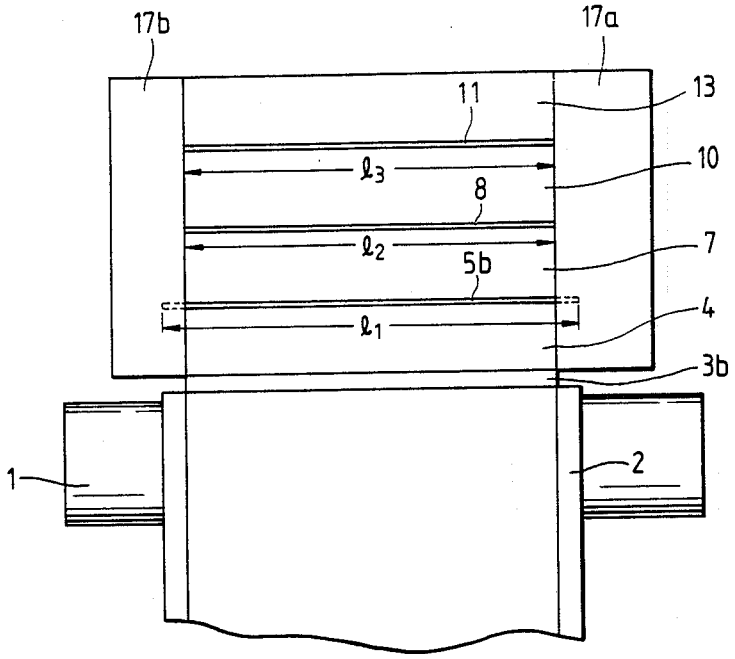
FIG. 6 shows a plan view of an application device which is the first embodiment of the present invention.

An example of the first embodiment to be applied to the device of FIG. 4 is shown in FIG. 6. The mechanism of FIG. 6 is obtained, based on the acknowledgement of the fact that, as shown in FIG. 4, the layers of applied liquid substances overlaid together on a slide surface form a bead 3*b* whose length is determined by application width control plates 17*a* and 17*b*. The essential feature of the first embodiment is that the length $l_1$ of a slot 5*b* for supplying water as the liquid substance for making the lowermost layer is larger than that $l_2$ of a slot 8 for supplying a water-soluble composite substances as the liquid substance for making the second lowermost layer. It is preferable that the length $l_1$ of the slot for supplying the liquid substance for making the lowermost layer be 3 mm to 40 mm larger than those $l_2$ and $l_3$ of the slots for supplying water-soluble composite substances which are the liquid substances for making the second and the third lowermost layers. It is more preferable that a condition $3 = l_1 - l_2 \leqq 25$ (mm) be added thereto.

A preferred example of the first embodiment to be applied to the device of FIG. 5 is described below. In the example, the length of the slot 24 for the lowermost layer is set to be larger than those of the slots 25 and 26. Therefore, the liquid substance 30 is applied to the web, with the length of the substance 30 being larger than the length of the liquid substances 31 and 32.

Although there is not a figure showing the relationship between the lengths of the liquid substance supply slots of the device, the relationship is the same as that in the mechanism shown in FIG. 6.

Since the length of the slot through which water for forming the lowermost layer on the web is supplied to a slide surface is made larger than that of each of the slots through which water-soluble composite substances for making the second and the third lowermost layers, respectively, are supplied to other slide surfaces, the quantity of the applied water is larger for the side edges of an application bead controlled by application width control plates than for the central portion of the bead, so that the side edges of the bead are continuous. For that reason, the liquid substances can be stably and rapidly applied to the web.

An actual example of this embodiment is hereafter described to make the effect of the embodiment understood more clearly.

[EXPERIMENT 1]

An experiment was conducted on an application device which is the actual example of this embodiment. The device was of the slide-hopper-type as show in FIG. 4. In the experiment, liquid substances, whose compositions and physical properties are shown in Table 1, were applied to a web under conditions described below. The web was made of cellulose triacetate and had a width of 18 cm.

TABLE 1

| Layer | Composition | Added quantity | Physical properties (at 40° C.) |
|---|---|---|---|
| Lowermost layer | Distilled water | | 0.65 cps in viscosity |
| Second | Gelatin | 50.0 g | 50 cps in viscosity |
| lowermost | Antihalation liquid | 200.0 g | |
| | Sodium dodecylbenzensulfonate | 2.5 g | 30 dyn/cm in surface tension |
| | Poly (potasium p-vinylbenzene sulfonate | 0.84 g | |
| | Water | 745.0 g | |
| Third lowermost layer | Gelatin | 50.0 g | 25 cps in viscosity |
| | Sodium dodecylbenzenesulfonate | 3.0 g | |
| | Poly (potassium p-vinylbenzene-sulfonate | 0.50 g | 28 dyn/cm in surface tension |
| | Water | 950.0 g | |

ACTUAL EXAMPLE OF EMBODIMENT

The liquid substances were applied as three layers under conditions shown in Table 2.

TABLE 2

| Slot | Slot length (cm) | Applied quantity (cc/cm-min.) |
|---|---|---|
| Slot for lowermost layer | 15.5 | 1.5 |
| Slot for second lowermost layer | 15.0 | 75.0 |
| Slot for third lowermost layer | 15.0 | 75.0 |

The liquid substances could be applied as the three layers under the above conditions without making the side edges of an application bead unstable at an application speed of 400 m/min. or less for the web.

COMPARATIVE EXAMPLE

The liquid substances were applied as three layers under conditions shown in Table 3.

TABLE 3

| Slot | Slot length (cm) | Applied quantity (cc/cm-min.) |
|---|---|---|
| Slot for lowermost layer | 15.0 | 1.5 |
| Slot for second lowermost layer | 15.0 | 75.0 |
| Slot for third lowermost layer | 15.0 | 75.0 |

The side edges of an application bead became unstable at an application speed of 250 m/min. or more for the web so as to make the surface of the assembly of the layer nonuniform.

According to the first embodiment, the length of a slot through which water for making the lowermost layer on a web is supplied to a slide surface is larger than those of slots through which watersoluble composite substances for making the second and the third lowermost layers are supplied to slide surfaces, so that the water sufficiently wets the side edges of an application bad to strengthen it against disturbances. For that reason, the layers can be stably and rapidly applied to the web to enhance the productivity.

[SECOND EMBODIMENT]

The simultaneous multilayer application method of the second embodiment of the present invention will be described hereinafter.

In the method provided in accordance with the second embodiment, liquid substances are applied as two or more mutually-overlaid layers to a continuously moving web, the liquid substance adjoining the surface of the web being water, and the other liquid substance adjoining the water having a larger thickness than the water layer and being a water-soluble composite substance of high viscosity. The method is characterized in that the viscosity of the liquid substance adjoining the water is 40 cps or more at the shear rate of 100 $sec^{-1}$.

The method of the second embodiment can be applied to the devices of FIG. 4 and 5. Since the viscosity of the liquid substance to be applied as the second lowermost layer adjoining the lowermost layer of the water on the web is 40 cps or more at the shear rate of 100 $sec^{-1}$, the liquid substance for making the second lowermost layer reduces the likelihood that the bead formed in the gap between the web on the backup roller and the application device will fall to the lip surface of the tip portion of the application device. The bead is thus formed more stably.

Actual examples of the second embodiment are hereafter described to make the effects of the invention understood more clearly.

[EXPERIMENT 2]

An experiment was conducted on an application method which is the actual example of the embodiment, as described below, with the use of the slide-hopper-type application device shown in FIG. 4. A web made of cellulose triacetate and having a width of 18 cm was used in the experiment.

ACTUAL EXAMPLE OF EMBODIMENT

Water of 0.65 cps in viscosity at a temperature of 40° C., an antihalation liquid containing an anion active agent of 120.0 cps in viscosity at a temperature of 40′ C. and a gelatin liquid containing an anion active agent of 20 cps in viscosity at a temperature of 40° C. were simultaneously applied to the web, at flow rates of 2 cc/cm-min., 75 cc/cm-min. and 75 cc/cm-min. as the lowermost layer on the web the second lowermost layer and the third lowermost layer, respectively. A transverse nonuniformity occurred due to the fall of an application bad at the application speed of less than 105 m/min. For the web. However, the application bead did not fall and cause the transverse nonuniformity at the application speed of more than 105 m/min. But not more than 350 m/min. For the web, so that the surface of the assembly of the layers was uniform.

COMPARATIVE EXAMPLE

Water of 0.65 cps in viscosity at a temperature of 40° C., an antihalation liquid containing an anion active agent of 10.0 cps in viscosity at a temperature of 40° C. and a gelatin liquid containing an anion active agent of 20.0 cps in viscosity at a temperature of 40° C. were simultaneously applied to the web, at flow rates of 2 cc/cm-min., 75 cc/cm-min. and 75 cc/cm-min. as the lowermost layer on the web, the second lowermost layer and the third lowermost layer, respectively. A transverse nonuniformity occurred due to the fall of an application bead at the application speed of 185 m/min. or less for the web. However, the application bead did not fall and cause the transverse nonuniformity at the application speed of more than 185 m/min., but not more than 341 m/min. for the web, so that the surface of the assembly of the layers was uniform.

It is understood from the comparative experiment that the range of the application speed at which the application bead does not fall and cause the transverse nonuniformity can be increased, ranging from 105 m/min. to 350 m/min., according to the second embodiment.

[EXPERIMENT 3]

An experiment was conducted on an application method which is the actual example of the second embodiment, as described below, with the use of the slide-hopper-type application devie shown in FIG. 4. A web made of polyethylene terephthalate (PET) having a subbing layer was used.

Three layers were applied onto the web simultaneously with one another under the following condition;

As the lowermost layer, water of 0.65 cps in viscosity at a temperature of 40° C. was applied at a flow rate of 2 cc/cm-min.

As the second lowermost layer, emulsion for a printing sensitive material of 25 cps, 40 cps and 80 cps in viscosity at a temperature of 40° C. were applied at a flow rate of 60 cc/cm-min, respectively. (The viscosity of the emulsions were adjusted with poly(p-vinylbenzenesulfonic acid potassium).)

As the third lowermost layer, protective layer for a printing sensitive material of 15 cps in viscosity at a temperature of 40° C. was applied at a flow rate of 15 cc/cm-min.

The application speed was changed to 150 m/min, 200 m/min and 250 m/min for all the three cases where the viscosity of the second lowermost layer were 25 cps, 40 cps and 80 cps, as described above. The bead clearance (distance between the web and the lip surface at the tip end portion of the application device) was selected to 0.25 mm for all the cases. The applied bead back pressure was selected to −80 mmAq for all the cases.

The results of the experiment were as shown in the Table 4.

TABLE 4

| viscosity of the emulsion layer | 25 cps | | | 40 cps | | | 80 cps | | |
|---|---|---|---|---|---|---|---|---|---|
| application speed (m/min) | 150 | 200 | 250 | 150 | 200 | 250 | 150 | 200 | 250 |
| nonuniformity due to the falling of the bead into the gap | • | • | • | • | | | | | |
| longitudinal streak | • | • | • | • | | | | | |

TABLE 4-continued

| viscosity of the emulsion layer | 25 cps | | | | 40 cps | | 80 cps |
|---|---|---|---|---|---|---|---|
| stepwise nonuniformity | • | • | • | • | | | • |

: not occurred
•: occurred

As apparent from the results, in the case where the viscosity of the emulsion layer as the second lowermost layer was selected to 40 cps or more, with the application speed in the range of 200 m/min, such a good result was obtained that there was not occurred any of the nonuniformity due to the falling of the bead into the gap between the web and the application device, the longitudinal streaks and the stepwise nonuniformity.

According to the second embodiment, the viscosity of a liquid substance to be applied as a layer adjoining a layer of water on a web is set at 40 cps or more at the shear rate of 100 $sec^{-1}$ so that the range of the application speed at which an appilcation bead does not fall and cause a transverse nonuniformity can be increased, as described above. Besides, the process of the application of the water and the liquid substance is stabilized.

[THIRD EMBODIMENT]

The simultaneous multilayers application device of the third embodiment of the present invention will be described hereinafter.

The simultaneous multilayer application device provided in accordance with the third embodiment applies liquid substances as two or more mutually-overlaid layers to a continuously moving web. The device is characterized in that the width of a slot for supplying the liquid substance for making the lowermost layer is made smaller than that of a slot for supplying the liquid substance for making the second lowermost layer. The width of the slot for supplying the liquid substance for making the lowermost layer is set at 0.05 mm to 0.7 mm, preferably 0.1. mm to 0.5 mm. The width of the slot for supplying the liquid substance for making the second lowermost layer is set at 0.1 mm to 1.5 mm, preferably 0.2 mm to 1.0 mm.

Figure 7:
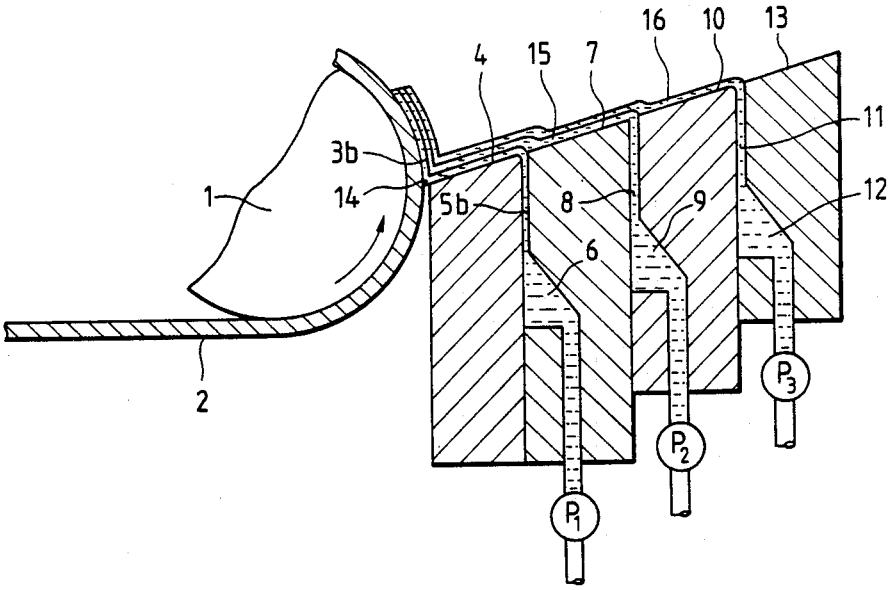
FIG. 7 shows a sectional view of a slide-hopper-type application device for simultaneously applying three layers in a stable rapid simultaneous multilayer application method to which the third embodiment of the present invention is applied.

In the case where the third embodiment is applied to the device of FIG. 4, the width of slot 5 for supplying a liquid substance for forming the lowermost layer on a web is made smaller than that of a slot 8 for supplying a liquid substance for forming the second lowermost layer, as shown in FIG. 7. As a result, a streak is not occurred as a defect in the surface of the assembly of the layers as done in the device of the publication No.54975/1988.

Figure 8:
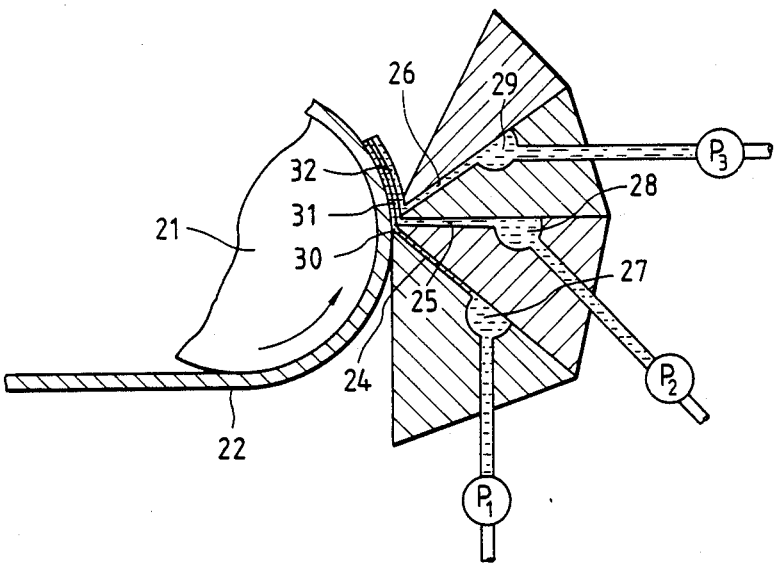
FIG. 8 shows a sectional view of an extrusion-type application device for simultaneously applying three layers in a stable rapid simultaneous multilayer application method to which the third embodiment of the present invention is applied.

In the case where the third embodiment is applied to the device of FIG. 5, width of a slot 24 for supplying a liquid substance for forming the lowermost layer on a web is made smaller than that of a slot 25 for supplying a liquid substance for forming the second lowermost layer, as shown in FIG. 8.

Since the width of the slot form forming the lowermost layer on the web is made smaller than that of the slot for forming the second lowermost layer, in the simultaneous multilayer application device provided in accordance with the third embodiment, the liquid substance supplied to make the second lowermost layer is prevented from falling into the slot through which the liquid substance is supplied for making the lowermost layer. As a result, a streak is not caused in the surface of the assembly of the layers, so that the surface is made uniform.

An actual example of the third embodiment is hereafter described to make the effect of the present invention understood more clearly.

[EXPERIMENT 4]

An experiment was conducted on an application device which is the actual example of embodiment. The device was of the slide-hopper-type as shown in FIG. 7. In the experiment, liquid substances whose compositions and physical properties are the same as shown in Table 1 were applied to a web under conditions described below. The web was made of cellulose triacetate and had a width of 18 cm.

COMPARATIVE EXAMPLE

Liquid substances were applied by a conventional slide-hopper-type application device in which slots for supplying the liquid substances are equal to each other in width. THe conditions of the application are shown in Table 5.

After a film made of the liquid substances applied at a speed of 150 m/min. was caused to gel by cold air, the film was dried in a conventional procedure and the surface of the film was inspected by eyesight. It turned out that very-slight longitudinal streaks had been caused in the surface of the film over the total width thereof.

TABLE 5

| Slot | Slot Width (mm) | Applied quantity (cc/cm-min.) |
|---|---|---|
| Slot for lowermost layer | 0.8 | 1.5 |
| Slot for second lowermost layer | 0.8 | 75.0 |
| Slot for third lowermost layer | 0.8 | 75.0 |

ACTUAL EXAMPLE OF EMBODIMENT

Liquid substances were applied by a slide-hopper-type application device which was an actual example of the embodiment of the present invention and in which the widths of slots for supplying the liquid substances were set along with other conditions as shown in Table 6.

TABLE 6

| Slot | Slot Width (mm) | Applied quantity (cc/cm-min.) |
|---|---|---|
| Slot for lowermost layer | 0.4 | 1.5 |
| Slot for second lowermost layer | 0.8 | 75.0 |
| Slot for third lowermost layer | 0.8 | 75.0 |

After a film made of the liquid substances applied at a speed of 150 m/min. was caused to gel by cold air, the film was dried in a conventional procedure and the surface of the film was inspected by eyesight. It turned out that no streak had been caused in the surface of the film. Therefore, the surface of the film was uniform.

In a simultaneous multilayer application device for applying liquid substances as two or more mutually-overlaid layers to a continuously moving web, the width of a slot for supplying the liquid substance for making the lowermost layer on the web is made smaller than that of a slot for supplying the liquid substance for making the second lowermost layer, in accordance with the third embodiment.

As a result, stable rapid simultaneous multi-layer application can be performed without causing a streak as a defect in the direction of the application.

The above-described first though third embodiments of the present invention can be combined with one another, as follows:

(1) Combination of the first and the second embodiments provides such the simultaneous multilayer application device for applying discrete liquid substances as at least two mutually-overlaid layers to a continuously moving web that comprises a continuously moving web, a backup roller around which the web moves, and a hopper for simultaneously applying upper and lower layers to the web, the hopper comprising first and second guide surfaces along which the liquid substances flow onto the web and first and second slots, whose lengths extend in a width-wise direction of the web, for individually supplying the liquid substances to each of the guide surfaces, wherein the length of the slot for supplying the lower layer is longer than the length of the slot for supplying the upper layer such that the edges of the applied liquid substances are continuous along the length of the web, and wherein the lower layer is water and the upper layer is water-soluble substance having a viscosity not less than 40 cps at a shear rate of 100 $sec^{-1}$.

(2) Combination of the first and the third embodiments provides such the simultaneous multilayer application device for applying discrete liquid substances as at least two mutually-overlaid layers to a continuously moving web that comprises a continuously moving web, a backup roller around which the web moves, and a hopper for simultaneously applying upper and lower layers to the web, the hopper comprising the first and second guide surfaces along which the liquid substances flow onto the web and first and second slots, whose lengths extend in a width-wise direction of the web, for individually supplying the liquid substances to each of the guide surfaces, wherein the length of the slot for supplying the lower layer is longer than the length of the slot for supplying the upper layer such that the edges of the applied liquid substances are continuous along the length of the web, and wherein the width of the slot for supplying the lower layer is smaller than the width of the slot for supplying the upper layer so as to prevent streaks from forming along the applied layers.

(3) Combination of the second and the third embodiments provides such the simultaneous multilayer application device for applying discrete liquid substances as at least two mutually-overlaid layers to a continuously moving web that comprises a continuously moving web, a backup roller around which the web moves, and a hopper for simultaneously applying upper and lower layers to the web, the hopper comprising first and second guide surfaces along which the liquid substances flow onto the web and first and second slots for indivisually supplying the liquid substances to each of the guide surfaces, wherein the width of the slot for supplying the lower layer is smaller than the width of the slot for supplying the upper layer so as to prevent streaks from forming along the applied layers, and wherein the lower layer is water and the upper layer is water-soluble substance having a viscosity not less than 40 cps at a shear rate of 100 $sec^{-1}$.

(4) Combination of the first, second and third embodiments provides such the simultaneous multilayer application device for applying discrete liquid substances as at least two mutually-overlaid layers to a continuously moving web that comprises a continuously moving web, a backup roller around which the web moves, and a hopper for simultaneously applying upper and lower layers to the web, the hopper comprising first and second guide surfaces along which the liquid substances flow onto the web and first and second slots, whose lengths extend in a width-wise direction of the web, for individually supplying the liquid substances to each of the guide surfaces, wherein the length of the slot for supplying the lower layer is longer than the length of the slot for supplying the upper layers such that the edges of the applied liquid substances are continuous along the length of the web, the width of the slot for supplying the lower layer is smaller than the width of the slot for supplying the upper layer so as to prevent streaks from forming along the applied layers and wherein the lower layer is water and the upper layer is water-soluble substance having a viscosity not less then 40 cps at a shear rate of 100 $sec^{-1}$.

Upon reading the detailed descriptions for the first through the third embodiments of the present invention described already, a skilled artisan would easily achieve the above-described four combinations. Furthermore, it is easily understood that the combinations of the embodiments may obtain at least the already-described advantages obtained by the corresponding respective embodiments.

An actual example of the combination (2) where the first and the third embodiments are combined is hereinafter described, in order to make the effect of the combination of the embodiments of the present invention understood more clearly.

[EXPERIMENT 5]

TABLE 7

| Slot | Slot length (cm) | Slot width (mm) |
|---|---|---|
| Slot for lowermost layer | 16.0 | 0.4 |
| Slot for second lowermost layer | 15.0 | 0.8 |
| Slot for third lowermost layer | 15.0 | 0.8 |

In the experiment, liquid substances as described below were applied to the web made of cellulose triacetate (TAC) and having a width of 18 cm.

Water of 0.65 cps in viscosity at a temperature of 40° C., an antihalation liquid containing an anion active agent of 60 cps in viscosity at a temperature of 40° C. and a gelatin liquid containing an anion active agent of 20 cps in viscosity at a temperature of 40° C. were simultaneously applied to the web, at flow rates of 2 cc/cm-min, 60 cc/cm-min and 15 cc/cm-min, as the lowermost layer on the web, the second lowermost layer and the third lowermost layer, respectively.

The bead clearance was selected to 0.25 mm, and the bead back pressure was selected to −40 mmAq.

The experiment was conducted with changing the application speed. As a result, it turned out that the uppermost limiting application speed with which the side edges of an application bad can be made stable was 450 m/min.

Furthermore, in order to examine the occurrence of the very-slight longitudinal streaks, the following experiment was conducted: After a film made of the liquid substances applied at a speed of 200 m/min was caused to gel by cold air, the film was dried in a conventional procedure and the surface of the film was inspected by eyesight. It turned out that no streak had been caused in the surface of the film due to the falling of the second lowermost layer into the slot for the water.

COMPARATIVE EXAMPLE

A comparative experiment was conducted with the conditions the same with those for the actual example of the present invention described above without the conditions of the width and the length of the slot for the lowermost layer. That is, the length of the slot for the lowermost layer was changed to 15.0 cm, and the width of the slot for the lowermost layer was changed to 0.8 mm. Therefore, the widths of the slots for the three layers were made equal to one another and the lengths of the slots for the three layers were made equal to one another.

As a result, it was turned out that the uppermost limiting application speed with which the side edges of an application bead can be made stable was 250 m/min, which was lower than the uppermost limiting application speed of the above-described example of the present invention.

Furthermore, in order to examine the occurrence of the very-slight longitudinal streaks, after a film mad of the liquid substances applied at a speed of 200 m/min was subjected to the experiment conducted for the actual example described above. As a result of the inspection by eyesight of the surface of the obtained film, it turned out that very-slight longitudinal streaks had been caused in the surface of the film over the total width thereof.

As described above, according to the simultaneous multilayer application method and apparatus of the present invention, rapid simultaneous multilayer application can be performed.

What is claimed is:

1. A method of simultaneous multilayer application to a continuously moving web, comprising the steps of:

continuously conveying said web around a backup roller;

simultaneously applying liquid substances as two or more mutually-overlaid layers to said continuously moving web, said liquid substance adjoining the surface of the web being water to form a lowermost layer and the other liquid substance adjoining said lowermost layer of water being a water-soluble substance having a viscosity not less than 40 cps at a shear rate of 100 $sec^{-1}$.

* * * * *